US009963285B1

(12) United States Patent
Zeldin

(10) Patent No.: US 9,963,285 B1
(45) Date of Patent: May 8, 2018

(54) FLEXIBLE BUCKET-TYPE DISPOSABLE CONTAINER

(76) Inventor: Yuri M. Zeldin, Hamden, CT (US)

( * ) Notice: Subject to any disclaimer, the term of this patent is extended or adjusted under 35 U.S.C. 154(b) by 1235 days.

(21) Appl. No.: 13/350,741

(22) Filed: Jan. 14, 2012

(51) Int. Cl.

| | |
|---|---|
| ***B65D 81/02*** | (2006.01) |
| ***B65D 81/05*** | (2006.01) |
| ***B65D 25/16*** | (2006.01) |
| *B65D 81/03* | (2006.01) |
| *B65D 77/06* | (2006.01) |
| *B44D 3/12* | (2006.01) |

(52) U.S. Cl.
CPC ..... *B65D 81/052* (2013.01); *B65D 25/16* (2013.01); *B44D 3/126* (2013.01); *B65D 77/06* (2013.01); *B65D 81/03* (2013.01)

(58) Field of Classification Search
CPC ..... B65D 25/16; B65D 81/03; B65D 81/052; B44D 3/126
USPC ..... 206/522, 524.6; 220/495.01–495.11; 383/3, 107, 108; 493/217, 255, 305
See application file for complete search history.

(56) References Cited

U.S. PATENT DOCUMENTS

| | | | | |
|---|---|---|---|---|
| 3,407,529 | A * | 10/1968 | Kellner | 43/57 |
| 4,044,867 | A * | 8/1977 | Fisher | 383/3 |
| 4,574,953 | A * | 3/1986 | Garbuzov | 206/522 |
| 4,705,085 | A * | 11/1987 | Brown | 206/522 |
| 4,858,755 | A * | 8/1989 | Kuivanen | 206/522 |
| 4,941,754 | A * | 7/1990 | Murdock | 383/3 |
| 5,108,195 | A * | 4/1992 | Perron | 383/10 |
| 5,169,025 | A * | 12/1992 | Guo | 220/739 |
| 5,598,946 | A * | 2/1997 | Davis | 220/739 |
| 5,791,476 | A * | 8/1998 | Stekloff | 206/521 |
| 5,845,806 | A * | 12/1998 | Parchman | 220/739 |
| 5,967,390 | A * | 10/1999 | Goryl | 383/3 |
| 6,283,762 | B1 * | 9/2001 | Wiggins | 206/591 |
| 7,108,650 | B2 * | 9/2006 | Marzano | 206/522 |
| 2003/0128898 | A1 * | 7/2003 | Malone et al. | 383/3 |
| 2004/0120611 | A1 * | 6/2004 | Kannankeril et al. | 383/110 |
| 2004/0144788 | A1 * | 7/2004 | Dorin et al. | 220/495.06 |
| 2010/0187234 | A1 * | 7/2010 | Saranga | 220/495.01 |

* cited by examiner

*Primary Examiner* — Luan K Bui

(74) *Attorney, Agent, or Firm* — Bardmesser Law Group

(57) ABSTRACT

A flexible elastic container having a configuration matching an internal configuration of a standard bucket is provided. The flexible elastic container clings to the inner surface of a bucket without any bubbles or wrinkles due to a specially selected wall material. Container walls are made of a thin plastic film. A bottom surface of the container is made from a bubble wrap material with a high number of bubbles per container's bottom. The film material making the container walls is attached to a bubble wrap material of the container bottom by glue or by a thermal impulse method.

8 Claims, 8 Drawing Sheets

FLEXIBLE BUCKET-TYPE DISPOSABLE CONTAINER

BACKGROUND OF THE INVENTION

Field of the Invention

The present invention is related to containers, and, in particular, to a flexible disposable bucket-like container.

Description of the Related Art

Plastic buckets of various shapes and sizes are commonly used all over the world. The field of use of these buckets is also quite broad from preparing concrete mixtures to storing chemicals. The most commonly used buckets are made in 1, 2 and 5 gallon sizes.

The main problem with the conventional bucket is their cost and utilization (recycling). Often, such expensive buckets are only used once, because they cannot be effectively cleaned from the mixture that they store, like paint or concrete. Therefore, the bucket needs to be disposed. However, proper disposal of the plastic buckets is also costly, since it requires for the plastic material of the buckets to be clean in order to have it melted (i.e., recycled).

The rigidity of the conventional plastic buckets also increases the disposal costs. For example, it requires a large area or a container for collecting a required minimal number of buckets for disposal. Collecting and transporting a large number of buckets to a cleaning and melting suite can also be very expensive. Cleaning and melting/recycling of the buckets might be not environmentally friendly as well.

In order to use the plastic buckets longer, disposable inserts (or bucket liners) had been introduced. However, the disposable inserts are only slightly less expensive than the buckets. Also, the inserts cannot be used without the bucket, as they lack the required characteristics (i.e., strength, stiffness and durability) for carrying the material in the insert without the bucket.

Accordingly, there is a need for light, flexible easily disposable buckets that provide all of the characteristics of the conventional rigid buckets.

SUMMARY OF THE INVENTION

The present invention is related to container systems, in particular, to a flexible disposable bucket. The present invention provides for an efficient inexpensive flexible bucket container that substantially obviates one or several of the disadvantages of the related art.

According to an exemplary embodiment, a flexible elastic container having a configuration matching an internal configuration of a standard bucket is provided. The flexible elastic container clings to the inner surface of a bucket without any bubbles or wrinkles due to a specially selected wall material. Container walls are made of a thin plastic film. A bottom surface of the container is made from a bubble wrap material with a high number of bubbles per unit area (about 45-55 bubbles for the bottom of a 5 gal. container, and 18-22 bubbles for a bottom of a 1 gal. container). The film material making the container walls is attached to a bubble wrap material of the container bottom by glue or by a thermal method.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
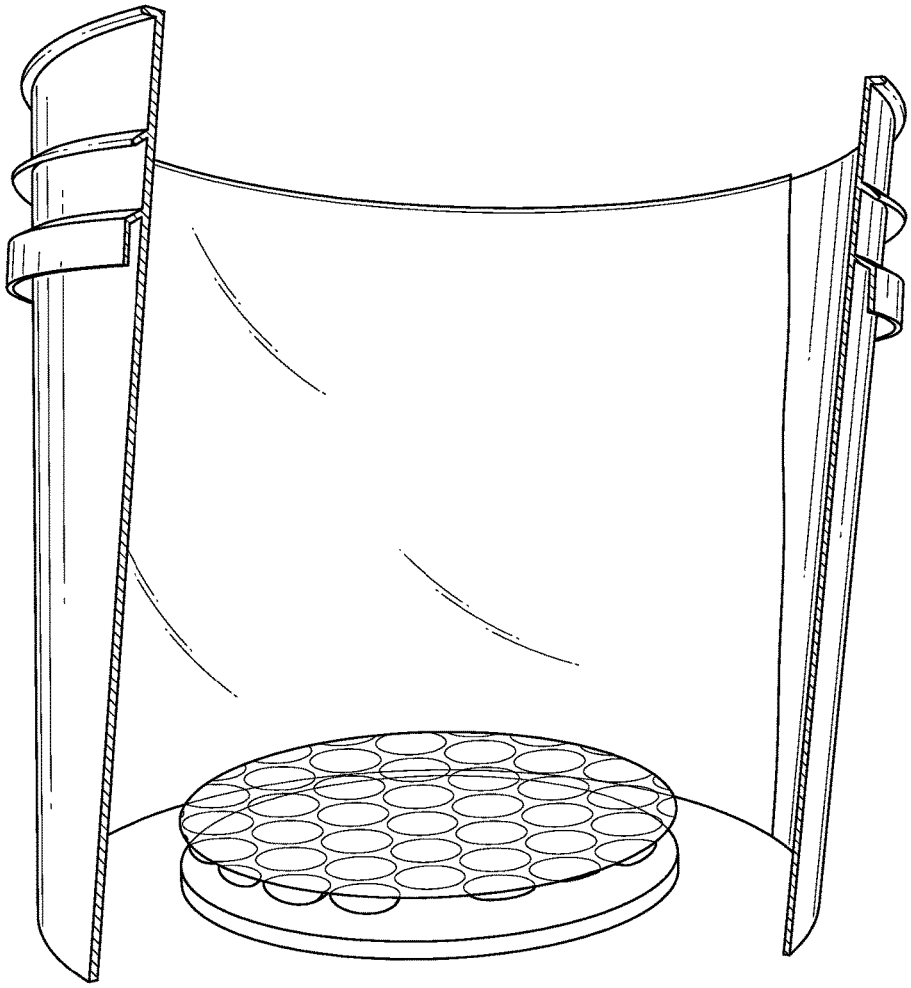
FIG. 1 illustrates a photo image of the two material used for the walls and for the bottom of the flexible containers.

Reference will now be made in detail to the preferred embodiments of the present invention, examples of which are illustrated in the accompanying drawings.

According to an exemplary embodiment a method for producing a flexible bucket container and the container are provided.

According to an exemplary embodiment, a flexible elastic container having a configuration matching an internal configuration of a standard bucket is provided. The flexible elastic container clings to the inner surface of a bucket without any bubbles or wrinkles due to a specially selected wall material. One reason is that the plastic container has a configuration that is very close to bucket configuration, and inserts into bucket tightly. Specially selected wall material is another reason for the good clinging effect.

Container walls are made of a thin plastic film. A bottom surface of the container is made from a bubble wrap material with a high number of bubbles per unit area (about 45-55 bubbles for the bottom of a 5 gal. container, and 18-22 bubbles for the bottom of a 1 gal. container). The film material making the container walls is attached to a bubble wrap material of the container bottom by glue or by a thermal method (impulse time 0.25 sec-10 sec, temperature roughly 105-200 degrees C., or 220-510 degrees F.).

According to the exemplary embodiment, a flexible container is produced in such a way that the walls and the bottom cling very tightly (without any wrinkles or bubbles) to the inner profile (configurations) of a standard rigid container. These characteristics are provided by experimentally selected materials that form the side walls and the bottom of the flexible container. Furthermore, when a mixture (e.g., concrete, paint, epoxy, etc.) is placed inside the flexible container, it increases the contact between the flexible container and the plastic container.

Note that when a mixing element is used inside the container, it only produces even better contact of the plastic container with the outside the ridged bucket due to the centrifugal forces created. However, high density mixtures (such as, for example, liquid concrete) in a still state—i.e., prior to using the mixing element—produce sufficient contact (clinging) between the flexible container and the rigid plastic container (or a bucket). The proposed flexible container performs much better than conventional inserts, which perform poorly with the mixing element.

Also, a bucket where paint or concrete had been mixed, typically, cannot be washed and re-used for other purposes. The exemplary embodiment allows for mixing the materials in the standard bucket, while the bucket remains clean and can be re-used almost indefinitely, considering the quality of the modern polymer plastic materials that the buckets are made of.

According to the exemplary embodiment, the bottom of the proposed flexible container is made of a bubble wrap-like material with an experimentally selected height of bubbles (12.5 mm).

This material has a 3-D "flowing" structure that provides for desired longitudinal, torsional and tensional resistance over long periods of time. For example, the bottom material can withstand forces created by a high speed drill or a mixer used inside the container for mixing the filler substance.

According to the exemplary embodiment, the desired combination durability and other properties of the proposed flexible container are provided by unique novel combination of the two materials—the plastic film (experimentally selected at roughly 0.1 mm thickness) and the bottom bubble material (with the bubble height of about 12.5 mm), and wall thickness of 0.09 mm-0.17 mm, according to manufacturer recommendations. This combination is advantageous, because the container walls have good cling ability properties and the bottom provides a very high degree of durability. In other words, the flexible container combines the best of the desired properties of the two different materials, as shown in FIG. 1 depicting a photo image of the two materials used.

The wall film is connected to the bottom of the container by a circular seam. According to the exemplary embodiment the circular seam is created by thermal method that employs melting the material together by thermal impulse adhesion, as described above.

Alternatively, the wall and the bottom materials can be attached by a glue suitable for plastic film, or other polymeric material. The circular seam has to be sufficiently strong to endure forces created by a mixing element or by weight of the filler substance. Note that the container matches the inner configuration of the bucket where the flexible container is placed into. The flexible container clings to the bucket so it does not rotate inside the bucket when the filler substance is stirred by the mixing element rotating at standard 550 rpm, with 45 rotations/min minimum, and 600 rotations/min maximum.

Figure 2:
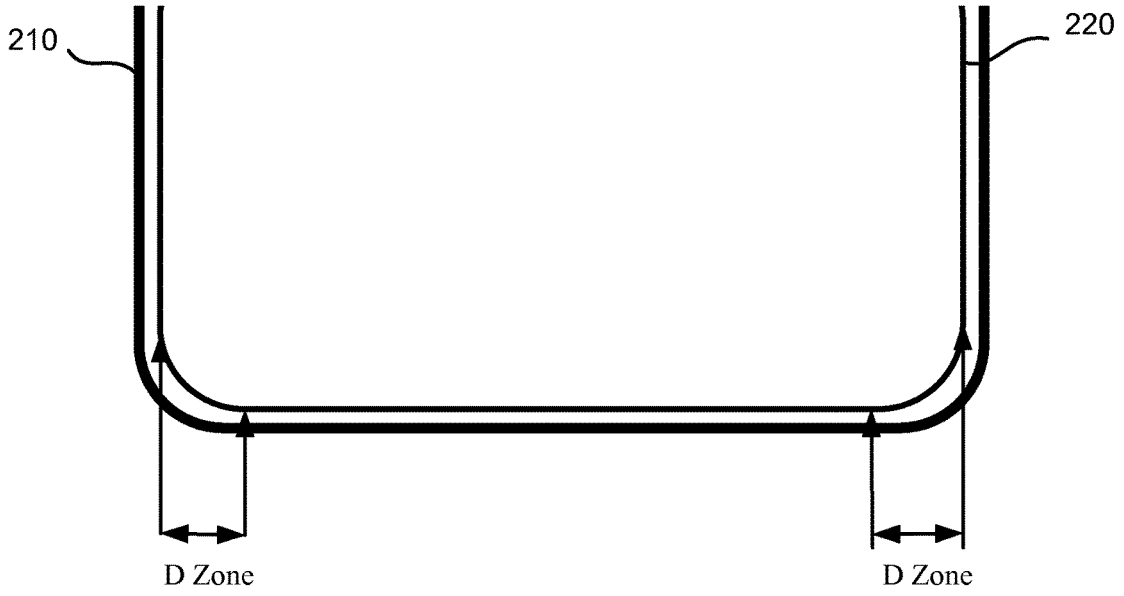
FIG. 2 illustrates how "dead zones" are implemented in the exemplary flexible containers.

Nevertheless, the circular seam has to endure significant forces and torque. According to the exemplary embodiment, this problem is solved by creating a "dead zone" along the circular seam, as shown in FIG. 2. A flexible container 220 is placed into the bucket 210. An area where the bottom is attached to the wall of the flexible container 220 is not susceptible to any forces or torques. In other words, it is a "dead zone" marked on the FIG. 2.

Creation of the "dead zone" advantageously solves the problem of a circular seam between two sorts of material that can be vulnerable to forces and torques. In order to increase clinging, the inner surface of the bucket can be watered. A film of water on the bucket walls creates a suction adhesion effect that increases clinging.

The circular seam can withstand pressure up to 5.4 pounds per inch, and it can withstand lengthening up to three original lengths, while for wall material it is 7 pounds per inch and up to 4.5 times original length; for bottom (bubble wrap) it is 3.5 pounds per inch and up to 3.3 times original length.

According to the exemplary embodiment this load is never applied to the seam due to created "dead zones." The circular seam remains in perfect order when the flexible container is taken out of the bucket. In order to find the optimal parameters for the materials of the flexible container, materials of the existing pouch bags (thickness roughly 0.1 mm and 0.17 mm) by Laticrete International Inc. had been examined. Also, bubble wrap (8 mm and 13 mm) had been tested for the bottom portion of the container.

Note that a heat gun or another commercial device producing the same result can be used for attaching the wall (i.e., a plastic film material) to the bottom (bubble wrap material) portion of the flexible container. The flexible containers advantageously take minimal space when being transported.

The volume of the flexible container, when it is rolled up after using the mixture in it, is approximately 14% of volume of a standard bucket. Additionally, the exemplary containers can be used as trash cans, camping waste, doggie walking bags, etc. The containers can be used in combination with the pipe segments (with no bottom), instead of the buckets. This combination of two items is much cheaper compared to a bucket-flexible container pair.

In order to determine the influence of structure, weight and composition of mixing materials on condition and clingability of flexible containers, the last were filled with water of room temperature, hot water, standard construction mortar and concrete which has sharp particles of gravel.

In all such tests mixing blade had maximum speed 550 rotations/min. According to experiments maximum stress usually applies to lower part of container (about 60% of its height from bottom up).

Figure 3:
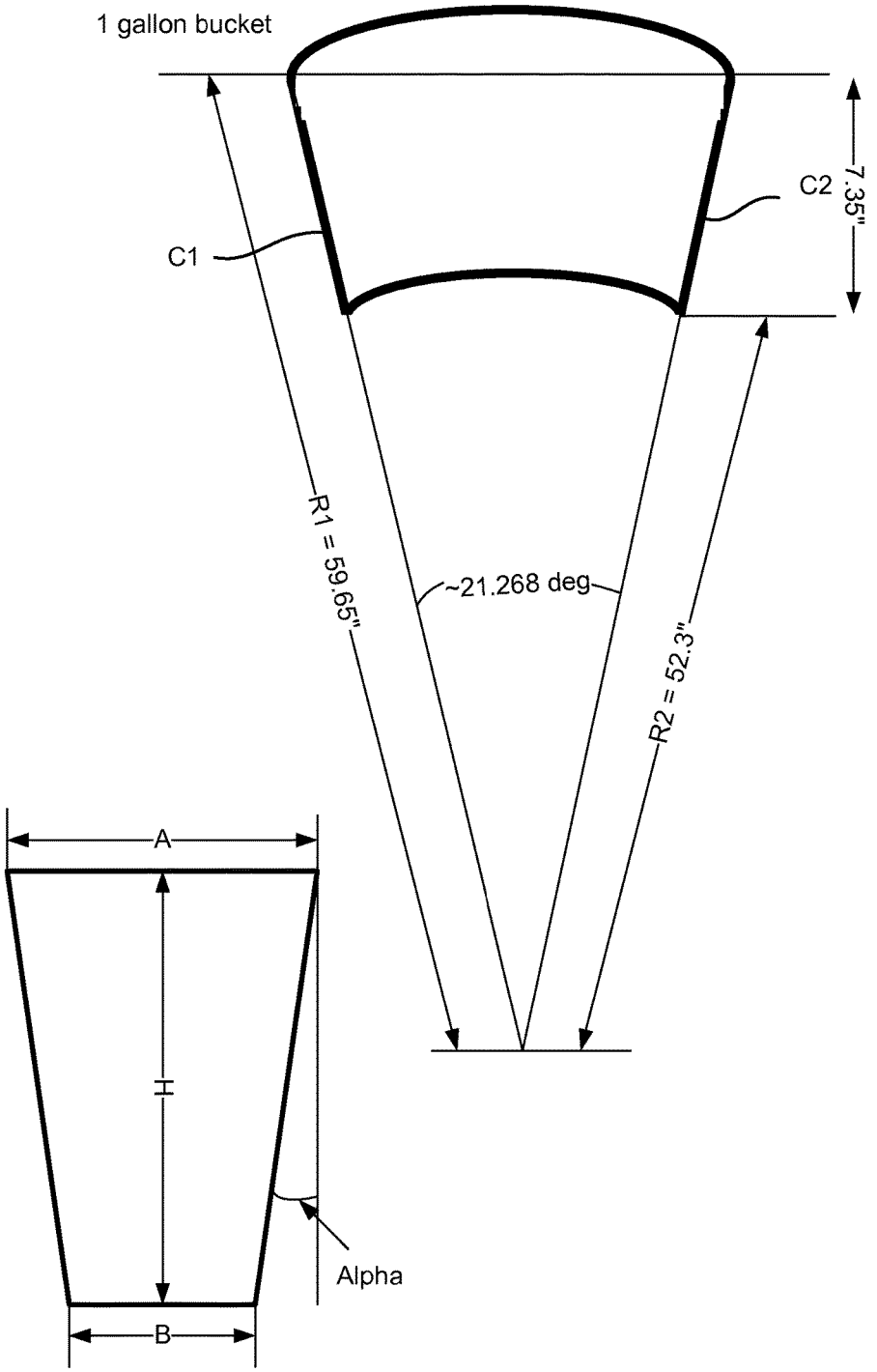
FIGS. 3 and 4 illustrate calculations relating to bucket strength.
Figure 4:
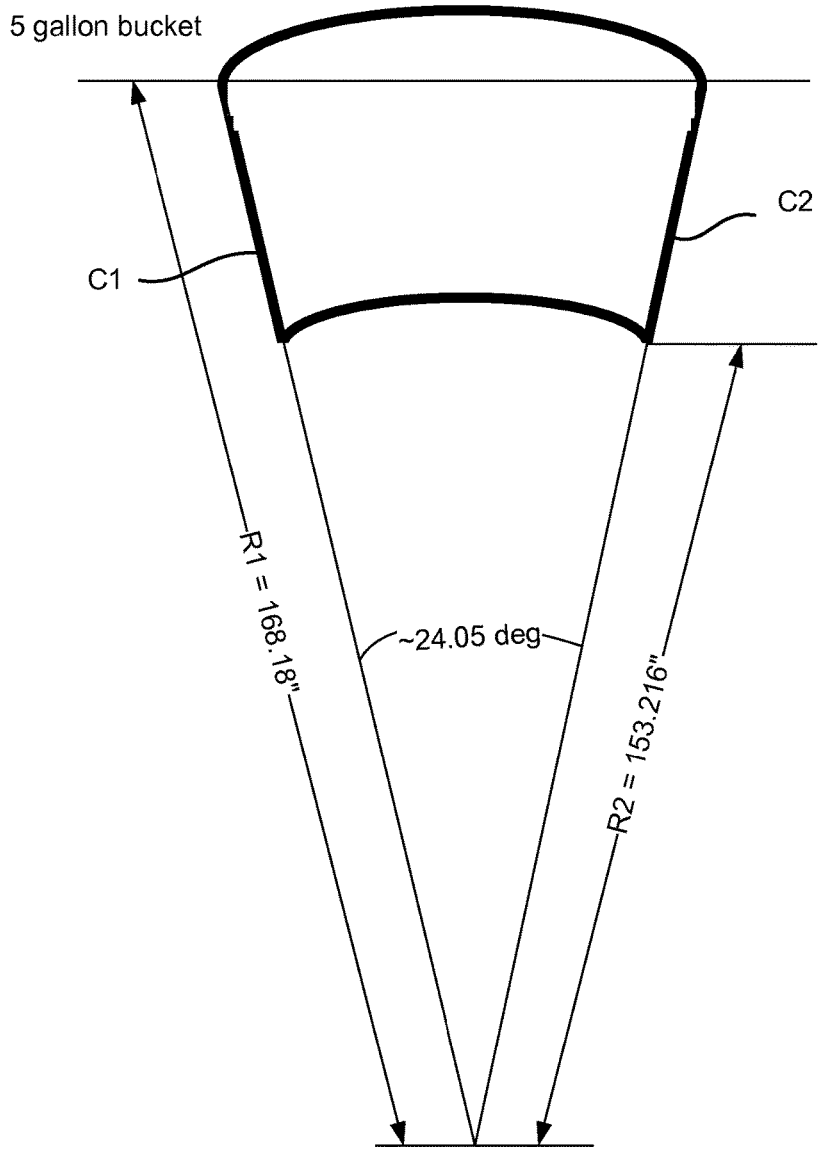

Geometrical formulas have been used to find inner areas and configuration of standard buckets with wall thickness 3 mm, see FIG. 3 and FIG. 4. To get as precise results as possible, which is important to final shape and sizes of flexible containers, large pieces of wall plastic, with thickness of 0.1 mm and about 70 feet long (for 1 gal. container), and 180 feet long (for 5 gal. container) were placed on firm, flat surface and affixed to it.

According to geometric formulas, radii for 1 gal. container are about 52 and 59 inches, and for 5 gal container—153 inches and 168 inches (see FIG. 3 and FIG. 4). When plastic has been cut along perimeter, its ends were connected by thermal method (lines C1 and C2).

Finally, the flexible plastic containers were inserted into standard buckets, and filled first with water of room temperature, then with hot water, standard construction mortar and concrete. After finishing mixing process in them, all sizes and configurations of tested flexible containers have been checked and corrected. As expected, standard construction concrete mix appeared to be the most destructive to flexible containers. Taking it into account, the plastic film for all mixes mentioned above is 0.11 mm, with two protective strips of glue, located on outer surface of container opposite to each other. In some cases, for example, when heavy concrete is being mixed, the wall thickness can be increased to 0.17 mm. Regarding container's configuration: Experiments proved that the distance between lines C1 and C2 (see FIG. 3 and FIG. 4) has to be reduced 1-2 mm for a 1 gal. container, and 2-3 mm for a 5 gal. container, because of impact of fast mixing process of heavy materials on wall plastic film.

Those skilled in the art will appreciate that the proposed system provides for a convenient, durable, easily disposable, flexible bucket-like container that considerably decreases the costs and environmental imprint by increasing usability of the conventional plastic buckets and containers.

In order to determine the influence of structure, weight and composition of mixing materials on condition and cling ability of flexible containers, the flexible containers were filled with water at room temperature, hot water, standard construction mortar and concrete which has sharp particles of gravel. In these tests, the mixing blade had maximum speed 550 rotations/min. According to experiments maximum stress usually applies to lower part of container (about 60% of its height from the bottom).

Geometric equations have been used to find inner areas and configuration of standard buckets with a wall thickness of 3 mm, see FIG. 3 and FIG. 4. To get as precise results as possible, which is important to final shape and sizes of flexible containers, large pieces of wall plastic, with thickness of 0.1 mm and about 70 feet long (for 1 gal. container), and 180 feet long (for 5 gal. container) were placed on firm, flat surface and fixed to it.

According to geometric equations, radius for 1 gal. container are 52 and 59 inches, and for 5 gal container—about 153 inches and 168 inches (see FIG. 3 and FIG. 4). When plastic has been cut along a perimeter, its ends were connected by thermal method (see lines C1 and C2).

Finally, made flexible plastic containers were inserted into standard buckets, and filled first with water at room temperature, then with hot water, standard construction mortar and concrete. After finishing mixing process in the bucket, all sizes and configurations of tested flexible containers have been checked and corrected.

It was experimentally determined that bubble wraps are very strong, and destroy under a pressure of 2-4 kg/cm$^2$ when pressure was applied to the entire bottom of the container, without stirring the material in it, and as high as 10 kg to the entire bottom, when a mixer is operating (which is much higher than actual pressures during typical mixing processes). The proposed container has good contact (clingability) between container and standard bucket. A unique combination of two materials in one product (flexible container)—plain plastic sheets and bubble wrap—is used. This provides for much better recycling opportunities, compared to standard buckets and inserts, since the amount of plastic materials needed to manufacture is many times less than with conventional buckets. The cost of the proposed flexible containers is between one seventh and one tenth of conventional bucket/inserts, and delivery to customers is cheaper. Also, advertising information can be easily printed on the container surface.

Experiments have been performed on plastic films for container's walls with thicknesses of 0.09-0.11-0.13-0.15-0.17 mm. There are several possible methods of manufacturing plastic flexible containers described and shown below.

1.a) The mold with outer shape equals to inner shape of standard ridged plastic container (wall thickness from 2.7 to 3.1 mm) are placed on conveyor.

1.b) A piece of plastic wall of flexible container, having a particular thickness and two strips of glue, pulls down the mold by using a Sleeve Machine. The bottom line of flexible container has the same position as the mold's bottom.

1.c) The container's bottom, made of bubble wrap, is fixed in a proper position by gluing or by thermal impulse treatment.

Figure 5:
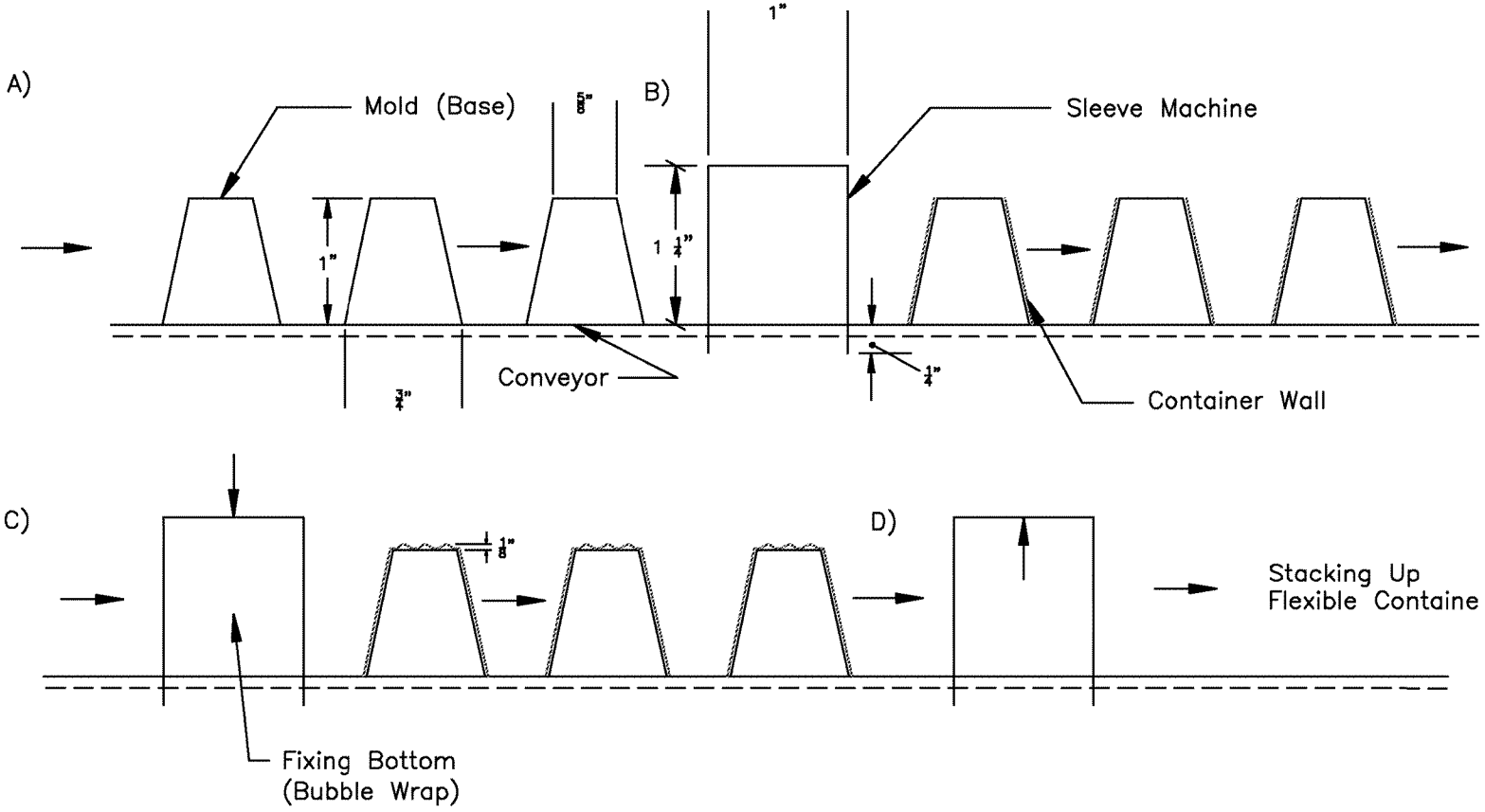
FIGS. 5-8 illustrate details of bucket manufacturing process.

1.d) Flexible containers are taken off molds and stacked up. (see FIG. 5).

2.a) A flat piece of flexible container's wall, with the container's bottom connected to it, is wraps up around the mold.

Figure 6:
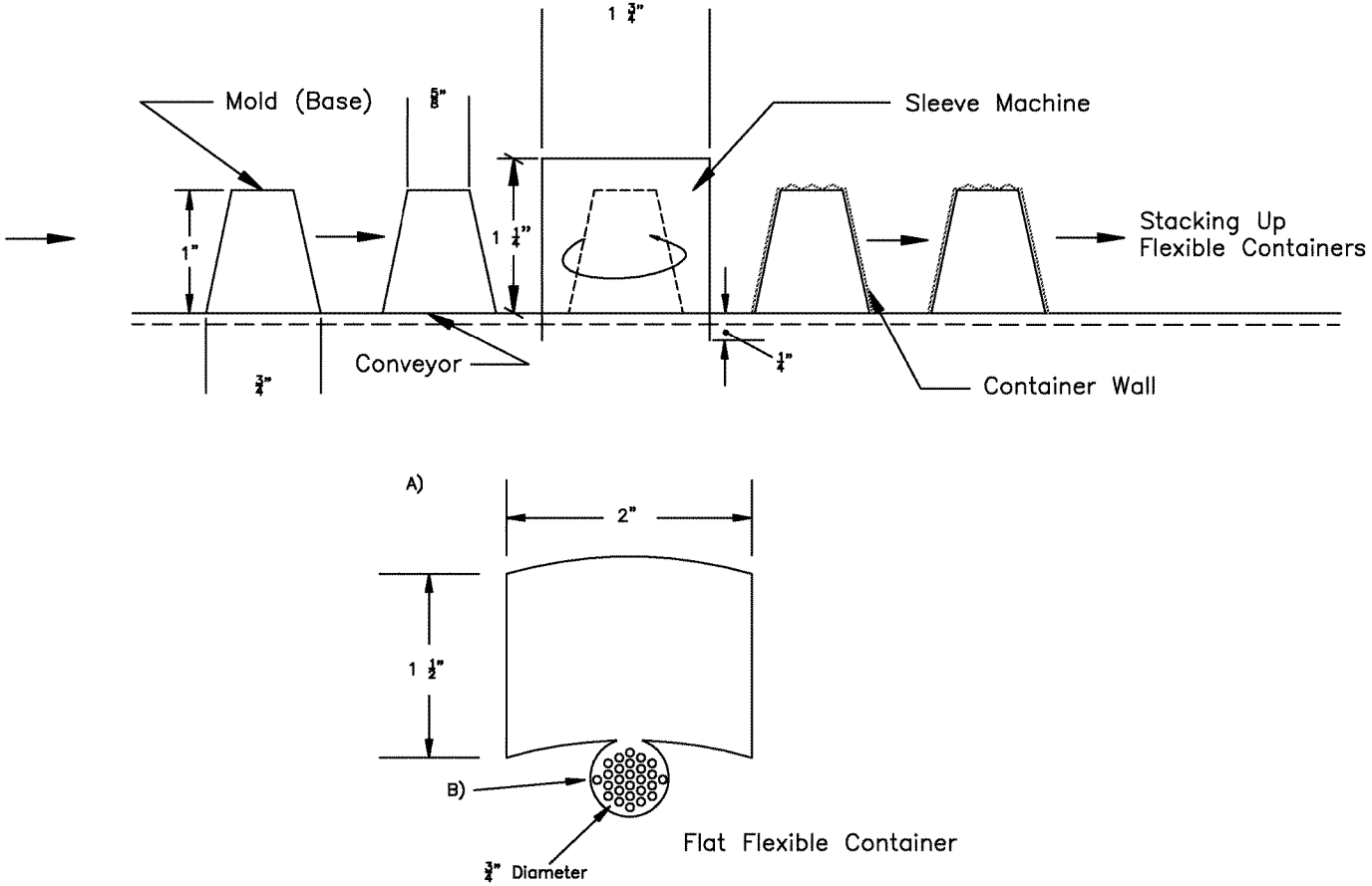

2.b) The container's bottom is fixed horizontally by gluing or by thermal impulse treatment. (see FIG. 6).

3.a) A thin sleeve (0.07-0.08 mm. of thickness) is pressed down the mold. This step can be avoided if the thickness of container's wall is more than 0.08 mm.

3.b) A piece of plastic flexible film having round shape and required thickness, is placed and centralized on top of the mold and fixed to plastic wall by the Sleeve Machine.

Figure 7:
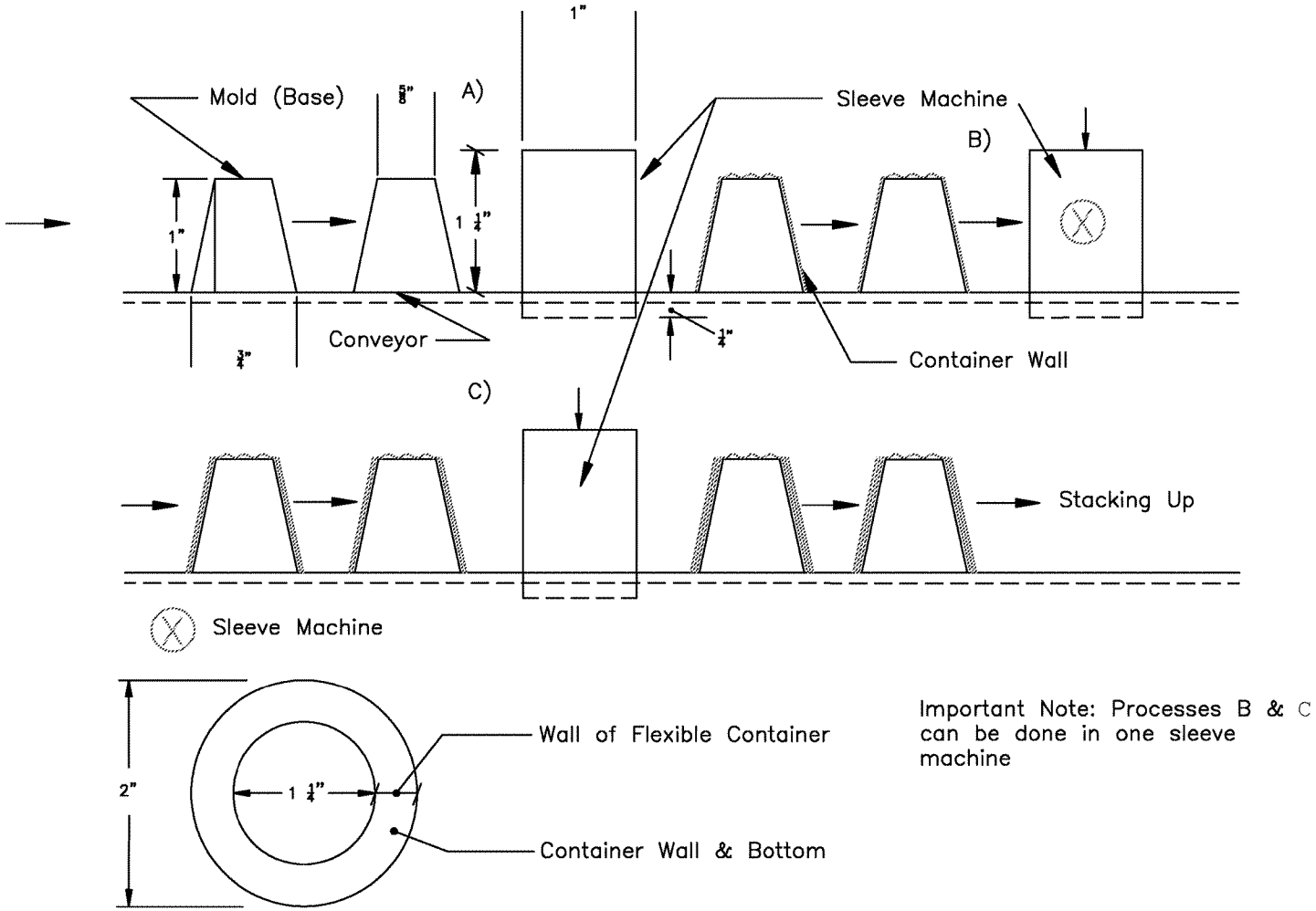

3.c) Same as 3.a (see FIG. 7).—Note that this step can be avoided.

Figure 8:
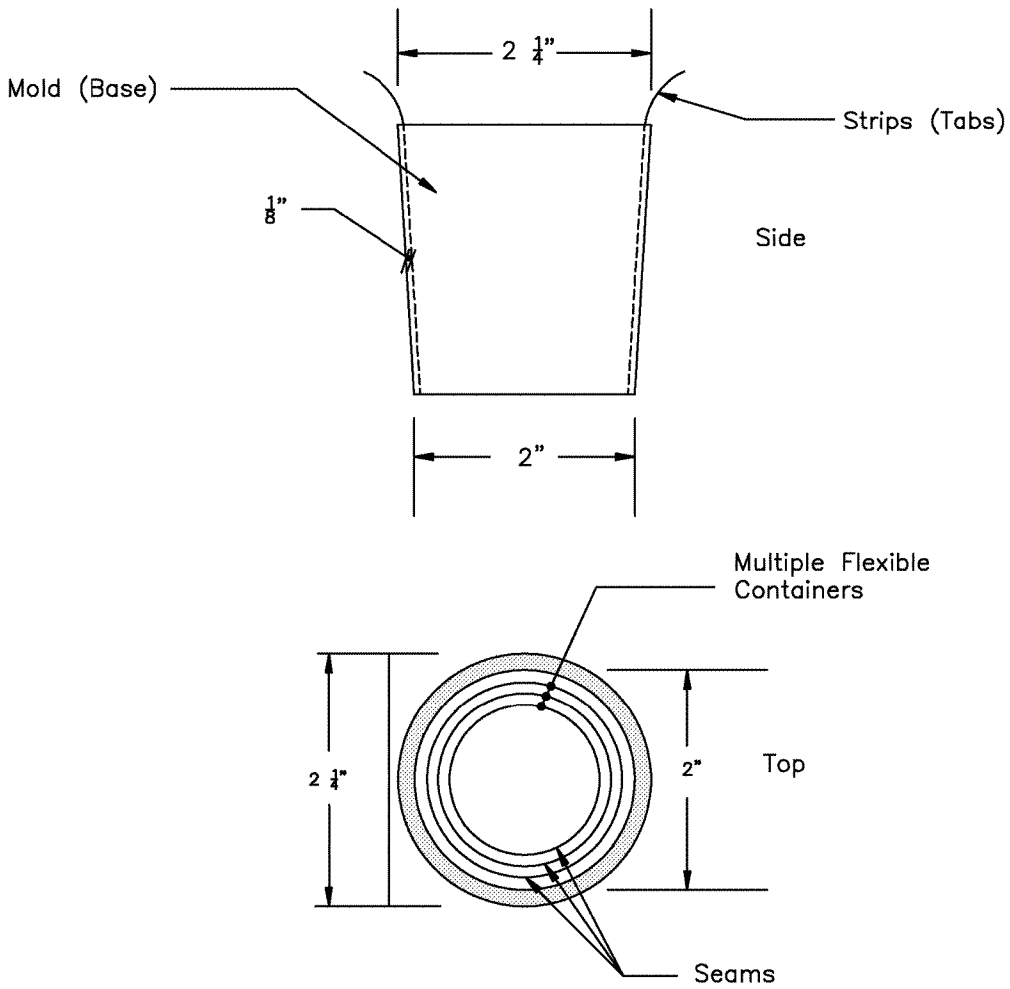

4.a) A base, or mold (standard bucket or round quick-tube pipe (diameter 10-12 inches) is formed of multiple plastic films, creating container walls, factory pressed against each other in a form of a pale or tube of various shapes and sizes from kitchen to industrial. The mold (or base) is filled with different materials, and, after mixing them, flexible containers are removed, one by one, eliminating the need to place in a replacement flexible plastic container. Marked strips, or tabs, would pull each container from the base (mold), exposing the next container (see FIG. 8).

Having thus described a preferred embodiment, it should be apparent to those skilled in the art that certain advantages of the described method and apparatus have been achieved.

It should also be appreciated that various modifications, adaptations and alternative embodiments thereof may be made within the scope and spirit of the present invention. The invention is further defined by the following claims.

What is claimed is:

1. A flexible disposable container, the container comprising:

a circular wall made of a polymer material and having a flat surface; and a circular bottom made of the same polymer material that includes air bubbles within it, with the bubbles facing outward and a flat surface facing inward into the container, wherein the circular wall is attached to the circular bottom by a thermally treated circular seam, and wherein the container, in a rolled up state, occupies approximately 14% of a volume of its unrolled state.

2. The container of claim 1, wherein the circular wall is made from the polymer material which is a plastic film with a thickness of approximately 0.1-0.17 mm.

3. The container of claim 1, wherein the circular bottom is a bubble wrap plastic with the height of the bubbles of approximately 12.5 mm.

4. The container of claim 1, wherein there is a "dead zone" between the circular wall and the circular bottom.

5. The container of claim 1, wherein a configuration of the container matches a configuration of an inner area of a standard bucket.

6. The container of claim 5, wherein the wall of the container clings tightly to inner wall of the standard bucket mechanically or by suction adhesion.

7. The container of claim 1, wherein the thermally treated circular seam produced by keeping the thermally treated circular seam at 100-200 degrees C., for 0.25-10 seconds.

8. The container of claim 1, wherein the polymer material is a plastic film of 0.09-0.17 mm thickness.

* * * * *